United States Patent [19]

Mista

[11] 4,220,362

[45] Sep. 2, 1980

[54] KNOTTING APPARATUS FOR SPOOLING MACHINES

[75] Inventor: Kresimir Mista, Obertshausen, Fed. Rep. of Germany

[73] Assignee: Karl Mayer Textilmaschinenfabrik, Obertshausen, Fed. Rep. of Germany

[21] Appl. No.: 940,766

[22] Filed: Sep. 8, 1978

[30] Foreign Application Priority Data

Sep. 16, 1977 [DE] Fed. Rep. of Germany ..... 2741785

[51] Int. Cl.[2] ..... A01D 59/04

[52] U.S. Cl. ..... 289/2; 242/35.6 R

[58] Field of Search ..... 289/2; 242/35.6 R, 35.6 E, 242/37 A

[56] References Cited

U.S. PATENT DOCUMENTS 4,105,228 8/1978 Messa ..... 289/2

*Primary Examiner*—Louis Rimrodt

*Attorney, Agent, or Firm*—Omri M. Behr

[57] ABSTRACT

A knotting apparatus for spooling machines includes a housing affixed on the spooling machine. The housing is divided into two sections; one section includes the driving linkages and the other section forms a compartment which houses the knotting mechanisms. The knotting mechanisms are operatively coupled to the linkages which, in turn, are coupled to the spooling machine for the driving thereof.

9 Claims, 6 Drawing Figures

KNOTTING APPARATUS FOR SPOOLING MACHINES

BACKGROUND OF THE INVENTION

1. Field of the Invention

The present invention relates to knotting apparatuses for spooling machines, and in particular, relates to a knotting machine which provides a separate compartment to house the knotting mechanisms thereby preventing dust and lint from entering the section that includes the driving linkages.

2. Description of the Prior Art

In practice, a plurality of spooling machines are placed in close proximity to each other. Generally, one knotting apparatus is utilized for a plurality of these machines and is moved from one machine to another as required. The present invention replaces the device utilized in the prior art which serviced a bank of spooling machines. The preferred embodiment of the present invention is affixed to a spooling machine and is operatively coupled thereto and derives its energy for operation from a backwardly and forwardly moving shaft therein.

The prior art knotting devices did not house the knotting mechanisms in a separate compartment, therefore any lint or dust in the atmosphere which is generated from the threads being knotted and trimmed would work its way into the driving linkages associated therewith, thus clogging these linkages and causing considerable downtime. In addition, the means for providing rotation of the binding heads did not permit smooth and exact operation thereof.

The present invention overcomes the shortcomings found in the prior art by providing a separate compartment for the knotting mechanisms, thereby eliminating any lint formed by the knotting operation from entering into the portion of the mechanism which houses the driving linkages. The crossing arms of the present apparatus are affixed to a plate which forms a wall of the compartment housing the knotting mechanisms, thereby eliminating a through path from the knotting compartment to the section which houses the driving linkages. With two separate sections, as disclosed in the present embodiment, the linkage mechanisms may be operated in a highly lubricated environment whereas the knotting mechanism need not.

A knotting apparatus for spooling machines, according to the principles of the present invention, comprises, in combination, housing means affixed on the spooling machine. The housing means is divided into two sections. The first sections has disposed therein the driving linkages. The second section has disposed therein the knotting mechanisms of the knott-apparatus. The knotting mechanisms are operatively coupled to the linkages. The second section defines a compartment which is adapted to receive thread therein for knotting. A pair of binding heads are disposed in the compartment and are operatively coupled to the linkages. Crossing means are disposed in the compartment also and are operatively coupled to the linkages. The crossing means includes a pair of crossing arms which cooperate with the pair of binding heads and interact with the threads to form knots. Driving means are provided in the first section which is operatively coupled to the spooling machine and the linkages for driving the crossing means and the binding heads. The driving linkages include a knotter shaft which is provided with a spirally formed channel and gear means on both ends thereof. One of the gear means is operatively coupled to each of the binding heads for providing rotation thereto and a driving pin is disposed within the spirally formed channel and is operatively coupled to the crossing means for providing rotary back and forth motion thereto.

BRIEF DESCRIPTION OF THE DRAWINGS

In order that the invention may be more fully understood, it will now be described, by way of example, with reference to the accompanying drawing in which.

DESCRIPTION OF THE PREFERRED EMBODIMENT

Figure 1:
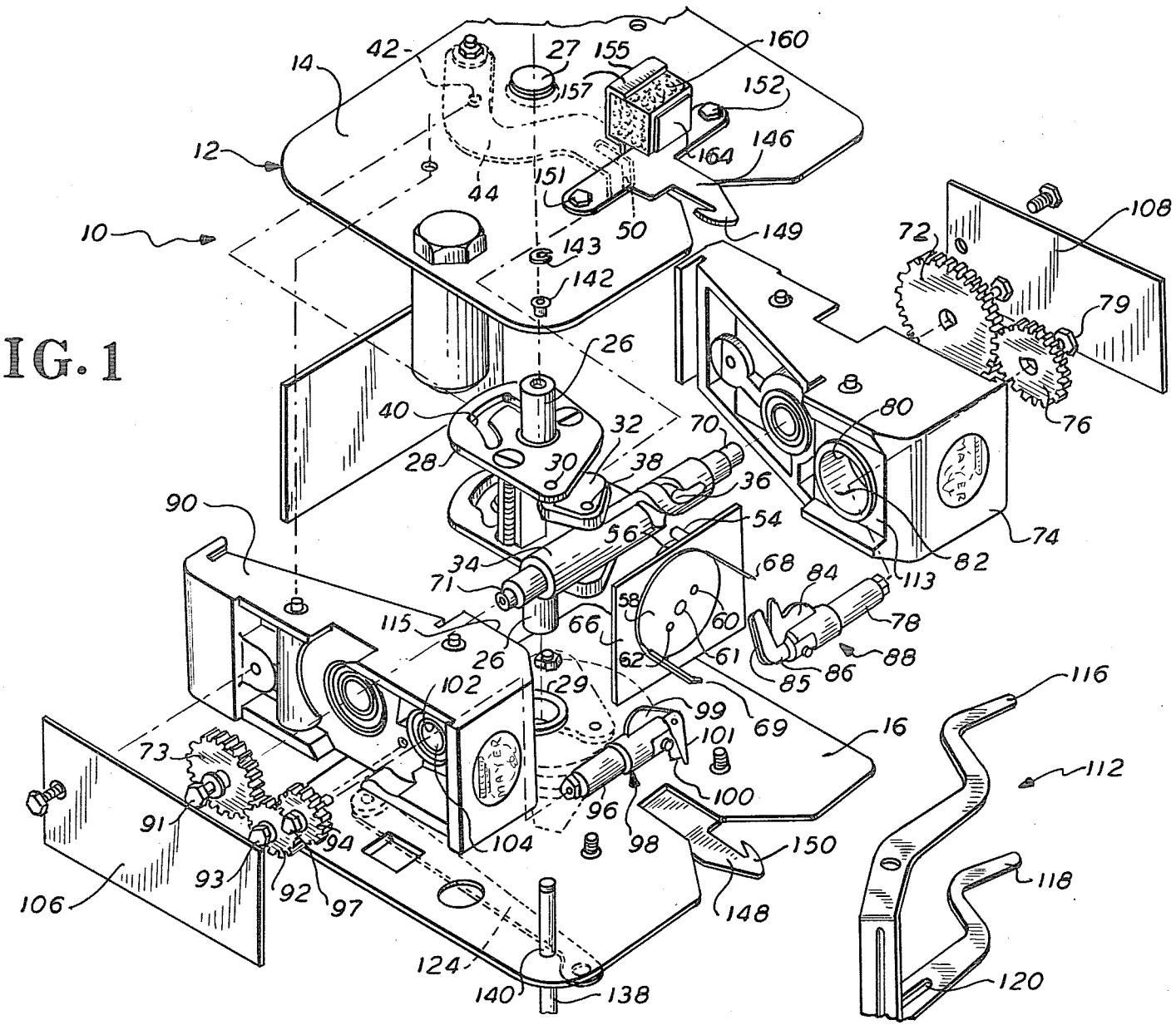
FIG. 1 is an exploded view of the knotting apparatus, according to the principles of the present invention.
Figure 2:
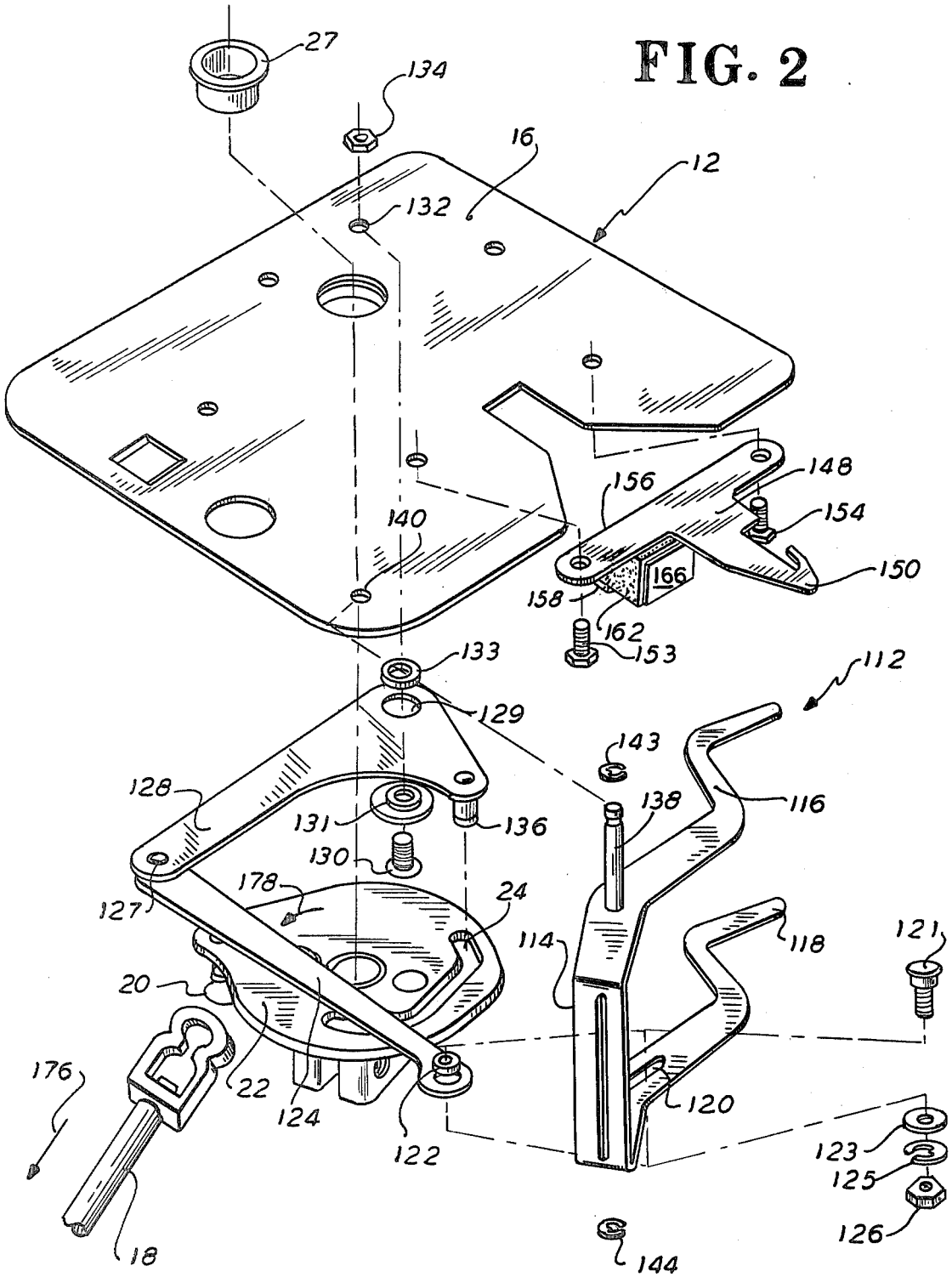
FIG. 2 is an exploded view of the underside of the apparatus shown in FIG. 1.

Referring now to the figures, and in particular, to FIGS. 1 and 2 which show an exploded view of the preferred embodiment of a knotting apparatus 10, according to the principles of the present invention. The knotting apparatus 10 is affixed to a spooling machine, not shown, in a conventional manner. The knotting apparatus may be considered to be divided into the knotting mechanisms, the elements which cooperate with each other and interact with the threads to form the actual knot and the driving linkages, which are coupled to the knotting mechanisms and activate and rotate the knotting mechanisms in proper sequence so that the threads applied to the knotting mechanisms may readily be knotted together. In the preferred embodiment, it will be seen that the knotting mechanisms and driving linkages therefore are disposed separate and apart from one another although coupled together. The advantages of such construction are obvious and include the ability for lubricating the driving linkages while in operation without affecting the knotting mechanisms or causing any of the lubrication to affect the threads. The sectionalization will become apparent as each of the elements are described in detail.

The knotting apparatus 10 is provided with a housing 12 which includes side walls 14 and 16. External to the housing 12 a drive shaft 18 (FIG. 2) is operatively coupled on one end to a spooling machine, not shown. The other end of the drive shaft 18 is journaled on an eccentric pivot 20 provided on drive disc 22. Drive disc 22 is provided with a channel or groove 24 whose function will be described hereinafter. Drive shaft 18 is provided with forward and backward motion from the spooling machine thereby imparting rotary motion to drive disc 22. The drive disc 22 is affixed to a drive shaft or spindle 26 in a conventional manner.

Figure 4:
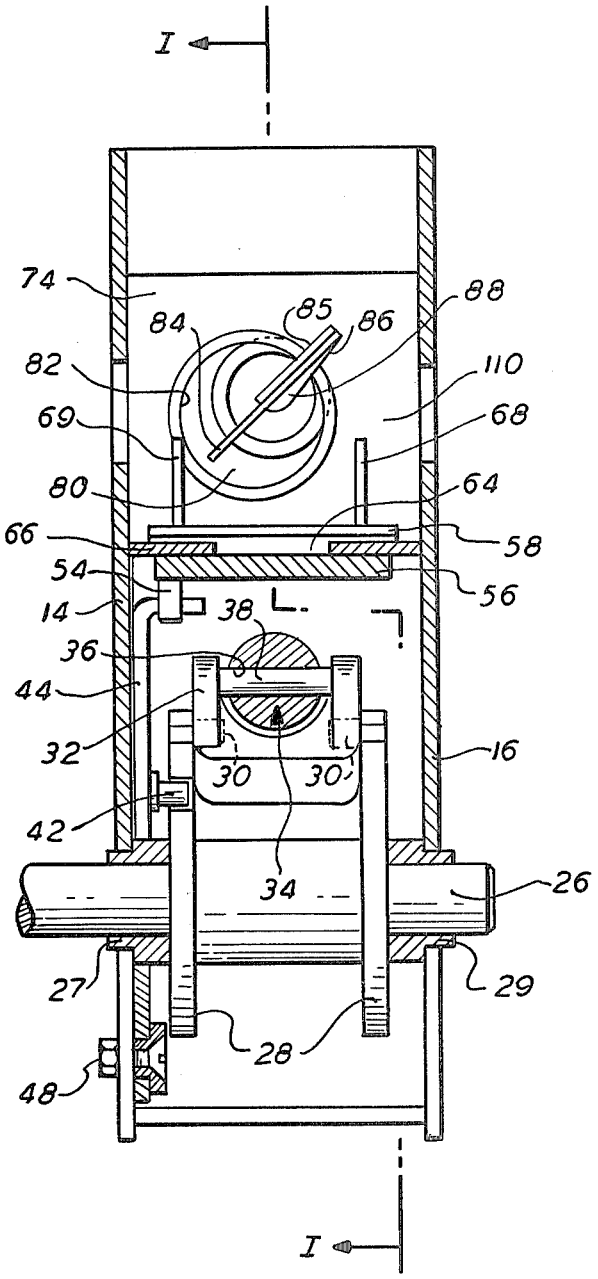
FIG. 4 is a cross-sectional view of the apparatus shown in FIG. 3 taken essentially along the line II—II.

A pair of drive cams 28 are provided on the drive shaft 26. The drive shaft 26 is journaled in the housing walls 14 and 16 by means of oilite bearings 27 and 29 provided therein (FIG. 4). A pair of drive pins 30 are provided in the extending portions of drive cams 28. Drive pins 30 are adapted to be received by and cooperate with lever or lever plate 32 which is generally U-shaped and surrounds a drive spindle 34 which is provided with a spirally shaped channel or groove 36. Groove 36 is adapted to slidably receive drive pin 38 therein. Drive pin 38 is affixed at both ends in U-shaped lever plate 32 thereby providing rigid and controlled motion of the guide pin in the groove 36.

Drive cam 28 is provided with a groove or channel 40 which is adapted to receive and cooperate with pin 42 provided in lever 44. The lever 44 is provided with an aperture 46 at one end thereof. Aperture 46 is adapted to be mounted onto pivot 48 thereby permitting the to and fro motion of lever 44. The opposite end of lever 44 is provided with a slot 50 which extends into the end portion 52 of lever 54. End portion 52 is bent at right angles to the remainder of lever 44.

Slot 50 is adapted to receive pin 54 provided in the underside portion 56 of crosser plate 58. Crosser plate 58 and the underside portion 56 thereof are held together by pins or rivets 61, 62 and 63 on either side of the shelf or wall 66 provided in the housing 12. Thus, to and fro motion of lever 44 will cause back and forth rotary motion of the crosser plate 58. A pair of crossing arms 68 and 69 are affixed to the crosser plate 58 and extend upwardly therefrom at 90 degrees.

The ends 70 and 71 of drive spindle 34 have affixed thereon, in a conventional manner, gears 72 and 73, respectively. The end 70 of drive spindle 34 is journaled in a molded spacerblock 74 to which wall plates 14 and 16 are affixed in a conventional manner. The end 70 of drive spindle 34 extends through spacer block 74 with gear 72 meshing with another gear 76 affixed to the end of binding head shaft 78 by means of a screw 79. Shaft 78 rotates in aperture 80 which is provided with an internal eccentric caming surface 82. The eccentric caming surface 82 cooperates with a pivotal gripping and cutting blade 84 which in turn cooperates with blades 85 and 86 on a binding head 88. Thus, rotation of the gear 76 will cause binding head 88 to rotate and will activate the cutting and gripping blade 84 because of the eccentricity of caming surface 82.

End 71 of drive spindle 34 is journaled in spacer block 90 and extends therethrough with gear 73 being affixed thereon by means of a screw 91. Gear 73 intermeshes with idler gear 92 which is journaled on screw 93 mounted in spacer block 90. Idler gear 92 meshes with gear 94 mounted on binding head shaft 96 by means of a screw 97. Binding head shaft 96 of binding head 98 is identical with binding head 88 and includes cutter blade 99 and gripping blades 100 and 101. Binding head 98 rotates in aperture 102 provided in spacer block 90 which is also provided with an eccentric caming surface 104 which cooperates with blade 99 and causes the movement thereof when the binding head is rotated. Since the drive spindle 34 is coupled to the binding head 98 via three gears 73, 92 and 94 on one end whereas it is coupled to binding head 88 and two gears 72 and 79 at the other end, the rotation of the binding heads 88 and 98 will be in opposite directions. Binding heads 88 and 98 are journaled in a wall which is extending at an angle of 90 degrees from the shelf or wall 66 and face each other.

Cover plates 160 and 108 may be used to cover the gears 73, 92 and 94 and gears 72 and 76, respectively, permitting the use of heavy lubrication thereof without coming into contact with the threads, not shown.

It is also to be noted, that the section of the knotting apparatus 10 that houses the drive shaft 26, drive cams 28, lever plate 32, drive spindle 34 and drive pin 38 may be heavily lubricated without affecting the knotting mechanisms appearing in the knotting mechanism compartment 110 delineated by crosser plate 58, walls 113 and 115 of spacer blocks 74 and 90, respectively, and side walls 14 and 16.

Referring now to FIG. 2, which shows an exploded view of the thread lifting mechanism 112 which is affixed on the underside of side wall 16 of the housing 12. The thread lifting mechanism 112 includes U-shaped bracket 114 which is provided with curved arms 116 and 118. Arm 118 is provided with a slot 120 which is adapted to receive screw 121 therein with spacer 122 permitting free movement of lever 124 when tightened into position in slot 120 by means of flat washer 123, block washer 125 and nut 127. The opposite end of lever 124 is provided with a shoulder rivet 126 which permits L-shaped bracket 128 to move freely. L-shaped bracket 128 is provided with an aperture 129 at the apex thereof. A screw 130 is adapted to be inserted into a shoulder washer 131 which in turn is inserted into aperture 129 which is in turn inserted into aperture 132 provided in wall 16 with a spacer washer 133 disposed therebetween. A nut 134 placed over screw 130 holds the assembly in position and functions as a pivot point for bracket 128. At the remaining extremity of bracket 128, guide pin 136 is provided. Guide pin 136 of bracket 128 is adapted to slidably engage channel 24 of drive disc 22.

Bracket 114 is provided with a pair of apertures adapted to receive spacer pin 138 which is adapted to mount into aperture 140 in wall 16 and aperture 142 in wall 14 (FIG. 1). A pair of C-retainers 143 and 144 placed over the ends of spacer pin 138 retains it in position permitting free movement of the U-shaped bracket 114. Thus, rotation of disc 22 will cause arms 116 and 118 to be raised at the proper time.

Additionally included on the outer surfaces of walls 14 and 16 are thread guides 146 and 148, respectively. The thread guides 146 and 148 are provided with a hook shaped portion 149 and 150, respectively, which guide the threads into proper position. The thread guides 146 and 148 are affixed to the walls 14 and 16 by means of screws 151, 152, 153 and 154, respectively. Thread guides 146 and 148 are provided with a portion thereof 155 and 156, respectively, which extend outwardly at approximately right angles to the main portion of the thread guides. In addition, a lip is provided on the outwardly extending portions 155 and 156. The lips 157 and 158, provided on guides 146 and 148 are used to position resilient, preferably rectangular shaped brake blocks 160 and 162. The brake blocks 160 and 162 are glued to the outwardly extending portions 155 and 156, respectively, in a conventional manner. The opposite face of the resilient brake blocks 160 and 162 are provided with a sheet 164 and 166 of relatively hard material. The sheet covers the exposed surface to the brake blocks 164 and 166 that is perpendicular to the thread guides 146 and 148. When the arms 116 and 118 are in their lowermost position, they enter an open space between the resilient brake blocks 160 and 162 and the thread guides 146 and 148. A pair of braking arms, not shown, cooperate with brake blocks 164 and 166 thereby clamping threads inserted therebetween during knotting.

Figure 3:
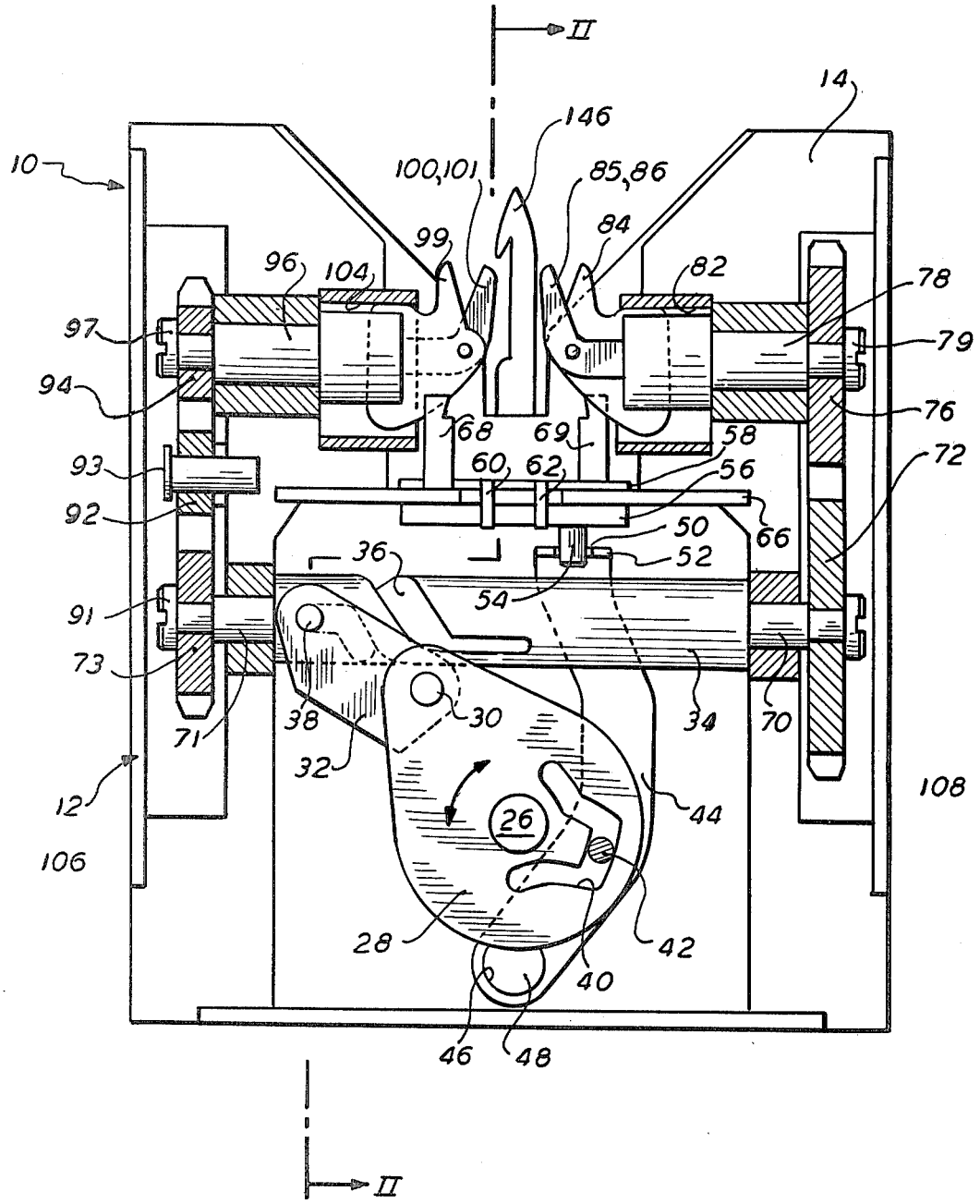
FIG. 3 is a cross-sectional view of the apparatus taken essentially along the line I—I of FIG. 4.

FIGS. 3 and 4 are cross-sectional views of the apparatus disclosed in FIGS. 1 and 2 and show the relative position of the parts when assembled.

Figure 5:
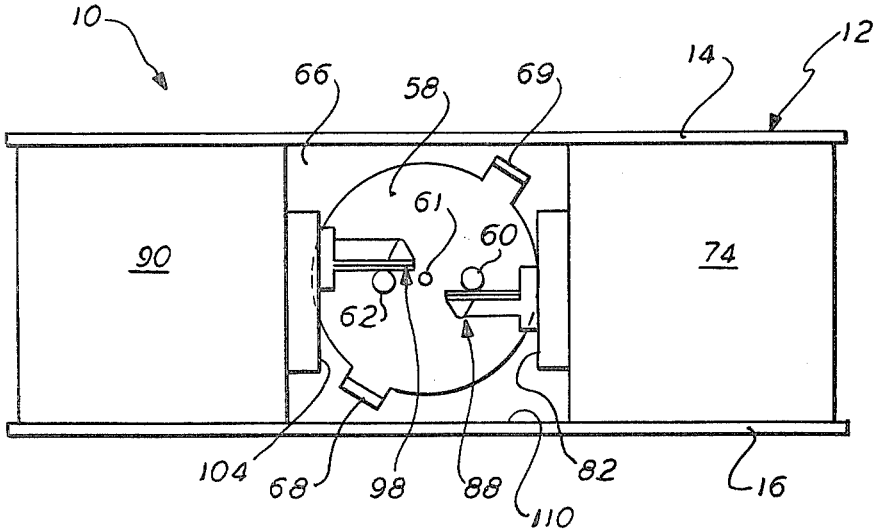
FIG. 5 is a partial plan view of the knotting apparatus shown in FIGS. 1–4 showing the crosser plate.

FIG. 5 is a plan view of the knotting apparatus which shows the knotting mechanisms which include the crosser plate 58, associated arms 68 and 60 and the binding heads 88 and 98. Thus, it is readily apparent that the knotting mechanisms are enclosed in a compartment separate and apart from the driving linkages.

Figure 6:
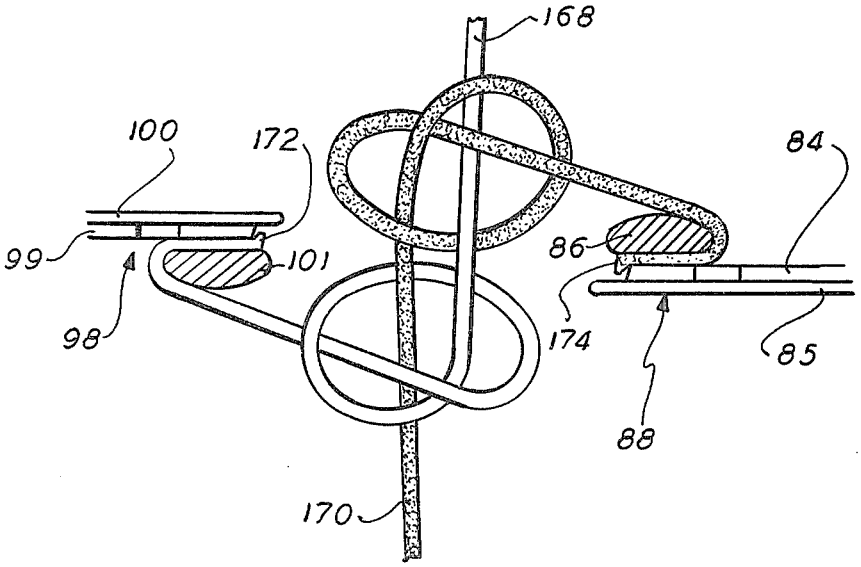
FIG. 6 shows the knot formed with two threads just prior to removal from the binding heads.

FIG. 6 discloses the configuration of two threads 168 and 170 that have been fed into the thread guides 148 and 140 and been permitted to complete a knotting cycle. The thread ends 172 and 174 are cut prior to removal from the knotting apparatus.

In operation, the threads 168 and 170 are fed into the open portion of thread guides 148 and 149. The thread lifting mechanism 112 is in its lowermost position at the start of the cycle and the braking arms, not shown, hold the threads against the brake blocks 164 and 166. As drive shaft 18 is moved in direction of arrow 176, drive disc 22 is caused to rotate in the direction of arrow 178, causing thread lifting mechanism 112 to be raised. The braking arms, not shown, clamp the threads to the brake blocks 160 and 162, respectively. Rotation of drive spindle 34 is also started causing rotation of the binding heads 88 and 98. With continual movement in the direction of arrow 176 of drive shaft 18 drive pin 38 is caused to move in channel 36 apply a rotary motion to the binding heads, via gears 72 and 76 and gears 73, 92 and 94. Rotation of the crosser plate 58 and the arms 68 and 69 associated therewith, is accomplished by the movement of lever 44 which is moved by the rotation of drive shaft 26 when guide pin 42 follows the channel 40 in drive cam 28. Thus, the complete sequence of events are provided in time sequence so that the knot shown in FIG. 6 may occur between threads 168 and 170.

Hereinbefore it has been disclosed a knot tying apparatus for spooling machines which provides knotting mechanisms in a compartment separate and apart from the driving linkages. It will be understood that various changes in the details, materials, arrangement of parts and operating conditions which have been herein described and illustrated in order to explain the nature of the invention can be made by those skilled in the art within the principles and scope of the present invention.

Having thus set forth the nature of the invention, what is claimed is:

1. A knotting apparatus for spooling machines comprising, in combination:

(a) housing means divided into two sections, the first of said sections and the second of said sections having disposed therein the driving linkages and the knotting mechanisms of said knotting apparatus, respectively, said knotting mechanisms being operatively coupled to said linkages, said second section defining a compartment and being adapted to receive threads therein for knotting;

(c) a pair of binding head means disposed in said compartment and operatively coupled to said linkages said binding head means including a cutting means operated by contact with a cam surface circumscribed thereabout, and one of said pair of binding head means being journaled in each wall of a pair of walls disposed at right angles to said one wall and facing each other; and (b) crossing means disposed in said compartment and journaled in one wall thereof operatively coupled to said linkages, said crossing means including a pair of crossing arms for cooperating with said pair of binding heads and interacting with said threads for forming knots;

(d) driving means disposed in said first section and operatively coupled to said spooling machine and said linkages for driving said crossing means and said binding heads.

2. A knotting apparatus for spooling machines comprising, in combination:

(a) housing means divided into two sections, the first of said sections and the second of said sections having disposed therein the driving linkages and the knotting mechanisms of said knotting apparatus, respectively, said knotting mechanisms being operatively coupled to said linkages, said second section defining a compartment and being adapted to receive threads therein for knotting, said driving linkages including a knotter shaft, said shaft being provided with a spirally-formed channel and gear means on both ends thereof, and driving pin means disposed within said spirally-formed channel and operatively coupled to said crossing means for providing rotary back and forth motion thereto;

(b) a pair of binding head means disposed in said compartment, each said binding head means being operatively coupled to one of said gear means for providing rotation thereto;

(c) crossing means disposed in said compartment and operatively coupled to said linkages, said crossing means including a pair of crossing arms for cooperating with said pair of binding heads and interacting with said threads for forming knots; and (d) driving means disposed in said first section and operatively coupled to said spooling machine and said linkages for driving said crossing means and said binding heads.

3. A knotting apparatus according to claims 1 or 2 wherein said means for providing rotary back and forth motion includes a driving cam coupled to said driving pin by means of a lever and a drive lever coupled to said driving cam.

4. A knotting apparatus according to claim 2 wherein said crossing means effectively forms one wall of said compartment.

5. A knotting apparatus according to claim 2 wherein said binding head includes a cutting means disposed therein operated by contact with a cam surface circumscribed thereabout.

6. A knotting apparatus according to claim 2 wherein said crossing means is journaled in one wall of said compartment and one of said pair of binding head means is journaled in each wall of a pair of walls at right angles to said one wall and facing each other.

7. A knotting apparatus according to claims 1 or 2 where said driving means operative coupling includes a driving disc with an eccentric pivot thereon and an oscillating drive shaft journaled on said pivot, said oscillating drive shaft being driven from said spooling machine.

8. A knotting apparatus according to claims 1 or 2 wherein said spirally-formed channel is clear through said knotted shaft, said driving pin means extends through said channel and is affixed on both ends thereof to a U-shaped lever plate of said crossing means, said U-shaped lever plate being operatively coupled to a pair of drive cams affixed on the drive shaft of said crossng means.

9. A knotting apparatus for spooling machines comprising in combination:

(a) housing means divided into two sections by an intervening wall, the first of said sections having disposed therein the driving linkages, the second of said sections defining a relatively closed compartment adapted to receive threads therein and having disposed therein the knotting mechanisms of said knotting apparatus, said knotting mechanishms being operatively coupled to said linkages;

(b) a pair of binding head means disposed in said compartment and operatively coupled to said linkages;

(c) crossing means disposed in said compartment and operatively coupled to said linkages, said crossing means including a pair of crossing arms for cooperating with said pair of binding heads and interacting with said threads for forming knots; and (d) driving means disposed in said first section, said driving means adapted to be operatively coupled to said spooling machine and operatively coupled to said linkages for driving said crossing means and said binding heads through the walls of said compartment while generally maintaining the integrity thereof.

* * * * *